US006049981A

United States Patent [19]

Mashiko

[11] Patent Number: 6,049,981

[45] Date of Patent: Apr. 18, 2000

[54] METHOD FOR MANUFACTURING A HEADER PIPE

[75] Inventor: Seiji Mashiko, Tokyo, Japan

[73] Assignee: Calsonic Corporation, Tokyo, Japan

[21] Appl. No.: 09/095,420

[22] Filed: Jun. 11, 1998

[30] Foreign Application Priority Data

Jun. 11, 1997 [JP] Japan ..... 9-153392
Jun. 3, 1998 [JP] Japan ..... 10-050536

[51] Int. Cl.[7] ..... B21H 1/04

[52] U.S. Cl. ..... 29/890.052; 29/890.054; 29/890.053

[58] Field of Search ..... 29/890.052, 890.053, 29/890.054, 428

[56] References Cited

U.S. PATENT DOCUMENTS 4,945,635 8/1990 Nobusue et al. ..... 29/890.053
5,119,552 6/1992 Sutou et al. ..... 29/890.052
5,243,842 9/1993 Kobayashi et al. ..... 29/890.052
5,329,995 7/1994 Dey et al. ..... 29/890.052
5,781,808 6/1998 Patel et al. ..... 29/890.052

FOREIGN PATENT DOCUMENTS 0165832 6/1990 Japan ..... 29/890.052
405066097 3/1993 Japan ..... 29/890.052

*Primary Examiner*—Irene Cuda
*Attorney, Agent, or Firm*—Sughrue, Mion, Zinn, Macpeak & Seas, PLLC

[57] ABSTRACT

A flat plate is molded in such a manner that a pair of semidivided cylindrical portions are arranged in parallel to each other with an arc-shaped connecting portion between them. Tube insertion holes are formed in one of the pair of semidivided cylindrical portions. Then, the connecting portion is projected from the inside thereof to thereby dispose the pair of semidivided cylindrical portions in such a manner that they are opposed to each other. The mutually opposed semidivided cylindrical portions are butted against each other, thereby manufacturing a cylindrically-shaped header pipe. The tube insertion holes are formed only in one of the pair of semidivided cylindrical portions in such a manner that the tube insertion holes are not allowed to extend up to the connecting portion.

8 Claims, 15 Drawing Sheets

METHOD FOR MANUFACTURING A HEADER PIPE

BACKGROUND OF THE INVENTION

1. Field of the Invention

The present invention relates to a method for manufacturing a header pipe which can be used as a tank in a heat exchanger.

2. Description of the Related Art

Conventionally, in a heat exchanger such as a capacitor or the like for use in a car, for example, as disclosed in Japanese Utility Model Publication No. Hei. 4-63982, a partition is provided in a header to thereby change the passage of fluid.

And, conventionally, a header with a partition of this type for use in a heat exchanger is manufactured in the following manner as shown in FIG. 15.

At first, a pipe member, which is formed of aluminum alloy and the outer surface of which is cladded with brazing material, is cut into a given dimension, thereby producing a pipe 11 for a header.

Then, in the pipe 11, there are formed tube insertion holes 13, a slit 15 for a divide, a fluid flow-in port 17, and a fluid flow-out port 19, respectively.

Next, an aluminum alloy divide 21 with the two surfaces thereof cladded with brazing material is inserted into the divide slit 15, and also two patches 23 formed of aluminum alloy are respectively pressure inserted into the two ends of the pipe 11 so as to manufacture a header pipe.

However, in such conventional header with a partition for use in a heat exchanger, use of an expensive pipe member which has been previously formed into a cylindrical shape increases the material cost thereof.

Also, the conventional header raises a fear that poor brazing can occur between the divide 21 and the pipe 11.

Conventionally, as a method which has solved the above problems, there is known a method for manufacturing a pipe with a partition disclosed in Japanese Patent Publication No. Hei. 7-314035.

According to the present method for manufacturing a pipe with a partition, as shown in FIGS. 16 and 17, there is manufactured a pipe with a partition structured such that it includes a partition portion 33 comprising a pair of semidivided partition portions 32.

In particular, this pipe with a partition is manufactured in the following manner:

At first, according to a molding step shown in FIGS. 18A–18C, a plate member formed of aluminum is molded so that there are formed a pair of semidivided cylindrical portions 35.

The pair of semidivided cylindrical portions 35 are arranged in parallel to each other with an arc-shaped connecting portion 37 between them.

And, in each of the pair of semidivided cylindrical portions 35, there is formed a U-shaped partition forming portion 39 which projects inwardly thereof.

Each of the pair of semidivided cylindrical portions 35 has a diameter smaller by 2 mm or so than the radius of a pipe portion 31 to be formed and, on the outside of each semidivided cylindrical portion 35, there is formed an edge portion 41.

The above-mentioned molding step can be achieved by holding the flat plate between given metal molds and then molding the same by pressing.

Next, according to a cutting step shown in FIGS. 19A and 19B, not only a portion of the connecting portion 37 situated between the partition forming portions 39 indicated by a shaded area A but also the edge portions 41 respectively situated on the two sides of the partition forming portions 39 are cut and removed together with the excessively increased thickness portions 41*a* of the edge portions 41.

This cutting step can be attained by trimming and piercing the flat plate using a piece of press work machinery.

Then, according to a compressing step, the partition forming portions 39 are respectively compressed from the two sides thereof in a direction of arrows B in FIGS. 20A and 20B to thereby form a semidivided partition portion 32.

This compressing step is tarried out in such a manner as shown in FIGS. 21A and 21B: that is, the outside portions of the two semidivided cylindrical portions 35 are held by a work holder 51 to be energized by springs 49, and, on the other hand, pressing members 53 are respectively disposed on the two sides of the partition forming portions 39 situated inside the two semidivided cylindrical portions 35; and, then, if the partition forming portions 39 are compression molded by the compressing members 53, then the semidivided partition portion 32 can be formed.

In the present compression molding operation, there is interposed a dimension correcting block 55 between the compressing members 53, so that the inward projecting length H of the semidivided partition portion 32 can be corrected by the dimension correcting block 55.

Next, according to an edge portion molding step shown in FIG. 22A and 22B, there are molded the two side edge portions 41 of the pair of semidivided cylindrical portions 35 in such a manner that, as shown in a lower side in FIG. 22, each edge portion 41 is formed in an arc shape which continues with its associated semidivided cylindrical portion 35.

This edge portion molding step can be achieved by holding the pair of semidivided cylindrical portions 35 between given metal molds and then molding the same by pressing.

Then, according to a mutually opposing step shown in FIGS. 23A and 23B, the connecting portion 37 is projected from the inside thereof to thereby dispose the pair of semidivided cylindrical portions 35 in such a manner that they are opposed to each other.

This mutually opposing step is carried out by storing the outside portions of the semidivided cylindrical portions 35 into a metal mold 57 and then pressing the connecting portion 37 against the arc-shaped portion 61 of the metal mold 57 using a punch 59.

Next, according to a butting step shown in FIGS. 24A and 24B, the mutually opposed semidivided cylindrical portions 35 are butted against each other.

This butting step is executed by storing the outside portions of the semidivided cylindrical portions 35 into a pair of metal molds (not shown) and then moving the metal molds. As a result of this, the semidivided cylindrical portions 35 are molded into a pipe shape.

Then, a connecting step is carried out: that is, not only the pair of semidivided cylindrical portions 35 but also the pair of semidivided partition portions 32 are connected to each other, so that the pipe with a partition shown in FIGS. 16 and 17 can be manufactured.

This connecting step can be achieved by performing, for example, a brazing operation using non-corrosive flux.

Now, FIGS. 25A and 25B show a header with a partition for a heat exchanger which is manufactured according to the above-mentioned method for manufacturing a pipe with a partition. The present header with a partition for a heat exchanger includes a partition portion 33 formed in the center portion of a cylindrically-shaped pipe portion 31A thereof.

Also, on one side of the outer periphery of the pipe portion 31A, there are formed a plurality of tube insertion holes 63 spaced at given intervals from each other.

Further, the openings of the two ends of the pipe portion 31A are respectively closed by cover members 65.

According to the present method for manufacturing a pipe with a partition, after completion of the edge portion molding step shown in FIGS. 22A and 22B, as shown in FIG. 26, there are formed, in one of the semidivided cylindrical portions 35, the tube insertion holes 63 in such a manner that they are spaced from each other at given intervals; and, at the same time, there are also formed a fluid flow-in port 67 into which a thermal medium is allowed to flow, and a fluid flow-out port 69 from which the thermal medium is allowed to flow.

This step can be achieved by slit/pierce molding using a piece of press work machinery.

In such header with a partition for a heat exchanger, since the pipe portion 31A including the partition portion 33 formed integrally therewith can be obtained easily, there is eliminated the need for use of the previously described expensive pipe member which has been previously formed into a cylindrical shape, thereby being able to reduce the material cost thereof greatly when compared with the previously described conventional header.

Also, when compared with the manufacture of the cylindrically-shaped pipe, the integral formation of the partition portion can reduce the number of parts, which makes it possible to reduce the cost of the header.

Further, since the tube insertion hole 63 can be worked in a semicircle state, the tube insertion hole 63 after molded can provide a sufficient strength, the working time thereof can be shortened, and thus the cost of the header can be reduced.

In addition, because the pair of semidivided cylindrical portions 35 and the pair of semidivided partition portions 32 can be connected to each other positively by brazing, it is possible to surely prevent the thermal medium from leaking externally from the partition portion 33.

However, according to the above-mentioned conventional method for manufacturing a pipe with a partition for use in a heat exchanger, in the molding step shown in FIGS. 18A–18C, as shown in FIG. 27, the radius R2 of the connecting portion 37 and the radius R1 of the semidivided cylindrical portion 35 are set substantially equal to each other, the peripheral length AB of the semidivided cylindrical portion 35, which extends from a connecting point A between the semidivided cylindrical portion 35 and connecting portion 37 to a virtual intersecting point B where a center connecting line L connecting the respective centers of the pair of semidivided cylindrical portions 35 with each other intersects the semidivided cylindrical portion 35, is set substantially the same as the peripheral length AC extending from the connecting point A to the center point C of the connecting portion 37; and also, the tube insertion holes 63 are respectively formed in such a manner that they extend up to the connecting portion 37. Hereupon, the end portion 63*a* of the tube insertion hole 63 is tapered to make the insertion of the tube into the tube insertion hole 63 easy in advance as shown in FIG. 28. However, if the mutually opposing step shown in FIGS. 23A and 23B and the butting step shown in FIG. 24 are carried out, then, there is raised a problem that the end portion 63*a* of the tube insertion hole 63 is deformed and the tapered portion is deformed so that the insertion of the tube into the tube insertion hole 63 becomes difficult.

SUMMARY OF THE INVENTION

The present invention aims at eliminating the above-mentioned drawbacks found in the conventional header pipe manufacturing methods. Accordingly, it is an object of the invention to provide a method for manufacturing a header pipe which is surely able to prevent the end portion of the tube insertion hole from being deformed.

According to the present invention, there is provided a method for manufacturing a header pipe, comprising the steps of: molding a flat plate so that a pair of semidivided cylindrical portions are arranged in parallel to each other with a connecting portion therebetween; forming a tube insertion hole in one of the pair of semidivided cylindrical portions so that the tube insertion hole is not allowed to extend up to the connecting portion; projecting the connecting portion to thereby dispose the pair of semidivided cylindrical portions so as to be opposed to each other; and butting the mutually opposed semidivided cylindrical portions against each other, thereby manufacturing a cylindrically-shaped header pipe.

In the above method, the connecting portion is arc-shaped in a cross section, and a radius of the connecting portion in the cross section is set smaller than a radius of the semidivided cylindrical portions in a cross section.

Further, a virtual peripheral length of the semidivided cylindrical portion in a cross section, which extends from a connecting point of the semidivided cylindrical portion and the connecting portion to a virtual intersecting point where a center connecting line connecting respective centers of the pair of semidivided cylindrical portions with each other intersect each of virtually extended peripheries of the semidivided cylindrical portions, is set substantially same as a peripheral length of the connecting portion in a cross section extending from the connecting point to a center point of the connecting portion.

According to a method for manufacturing a header pipe according to the present invention, the tube insertion holes are formed only in one of the pair of semidivided cylindrical portions in such a manner that the tube insertion holes are not allowed to extend up to the connecting portion, and, after then, the mutually opposing step and butting step are carried out to thereby manufacture the cylindrically-shaped header pipe.

Also, the radius of the connecting portion is set smaller than the radius of the semidivided cylindrical portion.

Further, the peripheral length of the semidivided cylindrical portion, which extends from the connecting point between the semidivided cylindrical portion and the connecting portion to a virtual intersecting point where the center connecting line connecting the respective centers of the pair of semidivided cylindrical portions with each other intersects each of the semidivided cylindrical portions, is set substantially the same as the peripheral length of the connecting portion extending from the above-mentioned connecting point to the center point of the connecting portion.

DETAILED DESCRIPTION OF THE PREFERRED EMBODIMENTS

Now, description will be given below of an embodiment of a method for manufacturing a header pipe according to the invention with reference to the accompanying drawings.

Figure 1:
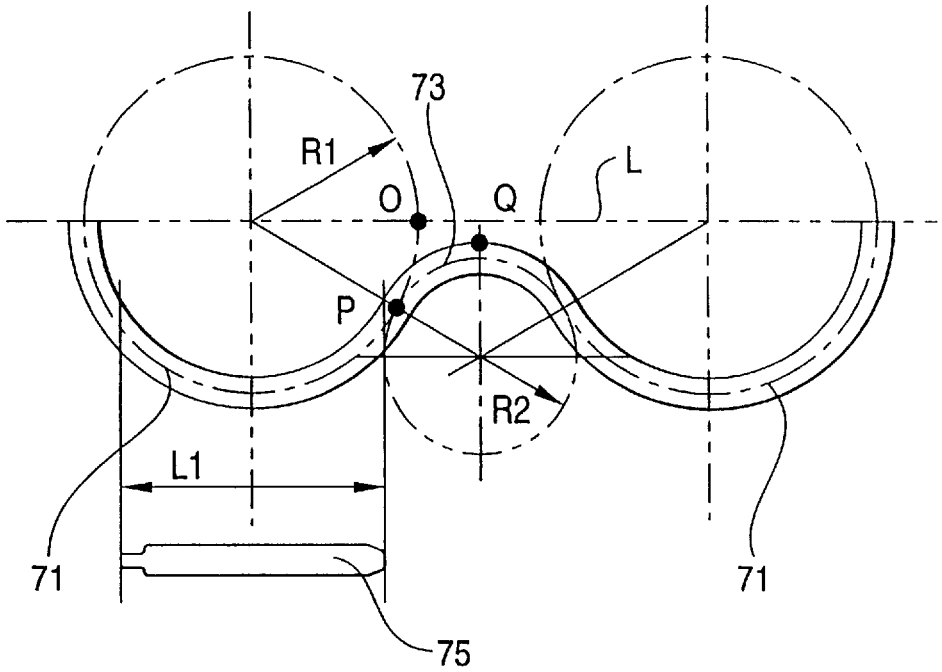
FIG. 1 is an explanatory view of an embodiment of a method for manufacturing a header pipe according to the invention, showing a state thereof after a molding step thereof is executed.

FIG. 1 is an explanatory view of an embodiment of a method for manufacturing a header pipe according to the invention, showing a state thereof after a molding step thereof is executed. In this state, as a result of molding of an aluminum flat plate, there are formed a pair of semidivided cylindrical portions 71 which are arranged in parallel to each other with an arc-shaped connecting portion 73 between them.

And, in the present embodiment, the radius R2 of the connecting portion 73 is set smaller than the radius R1 of the semidivided cylindrical portion 71.

Also, the virtual peripheral length P0 of the semidivided cylindrical portion 71, which extends from a connecting point P between the semidivided cylindrical portion 71 and the connecting portion 73 to a virtual intersecting point O where the center connecting line L connecting the respective centers of the pair of semidivided cylindrical portions 71 with each other intersects each of the virtually extended periphery of the semidivided cylindrical portions 71, is set substantially the same as the peripheral length PQ of the connecting portion 73 extending from the above-mentioned connecting point P to the center point Q of the connecting portion 73.

And, in the present embodiment, according to a tube insertion hole forming step to be executed later, in one of the semidivided cylindrical portions 71, there is formed a tube insertion hole 75.

The length dimension L1 of the tube insertion hole 75 is set such that one end of the tube insertion hole 75 is not allowed to extend up to the connecting portion 73.

This step is carried out by slit/pierce molding the aluminum flat plate using a piece of press work machinery.

Figure 2:
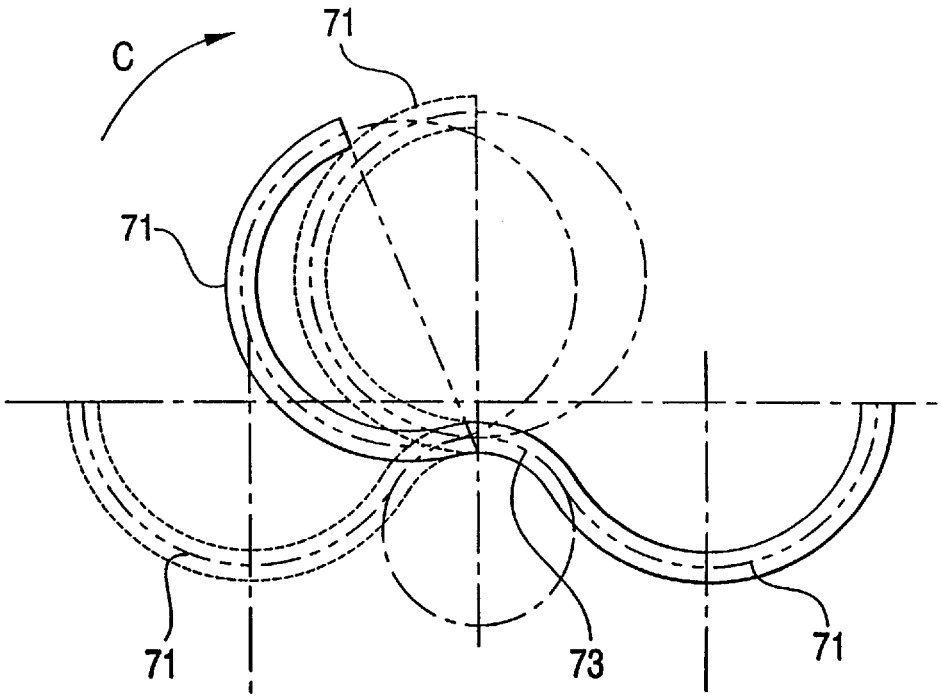
FIG. 2 is an explanatory view of a mutually opposing step and a butting step respectively employed in the above embodiment of a method for manufacturing a header pipe according to the invention.

After then, according to a-mutually opposing step, as shown in FIG. 2, the connecting portion 73 is projected from the inside thereof so that the pair of semidivided cylindrical portions 71 are disposed opposed to each other at an angular interval of, for example, 30 degree.

This mutually opposing step is executed by storing the outside portions of the semidivided cylindrical portions 71 into a metal mold and then pressing the connecting portion 73 against the arc-shaped portion of the metal mold using a punch.

Next, as shown in FIG. 2, according to a butting step, the mutually opposed semidivided cylindrical portions 71 are butted against each other in a direction of an arrow C.

According to the above-mentioned method for manufacturing a header pipe, since the tube insertion hole 75 is formed only in one of the semidivided cylindrical portions 71 in such a manner that it is not allowed to extend up to the connecting portion 73, when, after that the mutually opposing step and butting step are carried out to thereby manufacture the cylindrically-shaped header pipe, it is possible to surely prevent the end portion of the tube insertion hole 75 from being deformed.

Also, according to the above-mentioned method for manufacturing a header pipe, because the radius R2 of the connecting portion 73 is set smaller than the radius R1 of the semidivided cylindrical portion 71, it is possible to increase the outer peripheral length of the semidivided cylindrical portion 71, so that the length L1 of the tube insertion hole 75 can be set as the length that is required of a header pipe having a given outside diameter dimension.

That is, even if the length of the tube insertion hole 75 formed in the semidivided cylindrical portion 71 is shortened simply, there can be eliminated the need to extend the tube insertion hole 75 up to the connecting portion 73. However, in this case, the width of the tube with respect to the outside diameter dimension of the header pipe is reduced, which makes it difficult to obtain a heat exchange efficiency which is required of a header pipe having a given outside diameter dimension.

On the other hand, according to the present embodiment, as described above, since the radius R2 of the connecting portion 73 is set smaller than the radius R1 of the semidivided cylindrical portion 71, it is possible to increase the outer peripheral length of the semidivided cylindrical portion 71, so that the length L1 of the tube insertion hole 75 can be set easily as the length that is required of a header pipe having a given outside diameter dimension.

Further, according to the above-mentioned header pipe manufacturing method, since the virtual peripheral length PO of the semidivided cylindrical portion 71, which extends from a connecting point P between the semidivided cylindrical portion 71 and the connecting portion 73 to a virtual intersecting point O where the center connecting line L connecting the respective centers of the pair of semidivided cylindrical portions 71 with each other intersects each of the virtually extended periphery of the semidivided cylindrical portions 71, is set substantially the same-as the peripheral length PQ of the connecting portion 73 extending from the above-mentioned connecting point P to the center point Q of the connecting portion 73, after then, by carrying out the mutually opposing step and butting step, the cylindrically-shaped header pipe can be produced positively.

Now, description will be given below of an embodiment of a method for manufacturing a header pipe according to the invention with reference to the accompanying drawings.

In the present embodiment, a header pipe with a partition is manufactured from an aluminum flat plate.

Figure 3A:
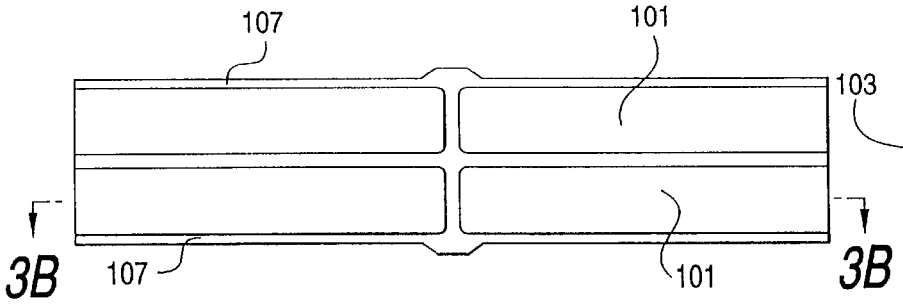
FIGS. 3A–3C are explanatory views of a molding step employed in the above embodiment of a method for manufacturing a header pipe according to the invention.
Figure 3C:
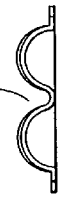
Figure 3B:
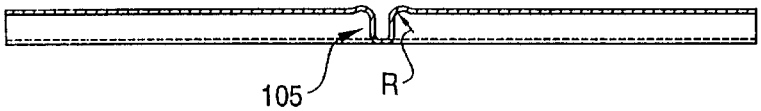

The present header pipe is manufactured in the following manner:

That is, at first, according to a molding step shown in FIGS. 3A–3C, an aluminum plate member including brazing layers on the two surfaces thereof is molded to thereby form a pair of semidivided cylindrical portions 101.

The pair of semidivided cylindrical portions 101 are arranged in parallel to each other with an arc-shaped connecting portion 103 between them.

And, in each of the pair of semidivided cylindrical portions 101, there is formed an inwardly projecting, U-shaped partition forming portion 105.

Each of the semidivided cylindrical portions 101 includes an edge portion 107 on the outside thereof.

And, according to the present embodiment, as shown in FIG. 1, the radius of the connecting portion 103 is set smaller than the radius of the semidivided cylindrical portion 101.

Also, the virtual peripheral length of the semidivided cylindrical portion 101, which extends from a connecting point between the semidivided cylindrical portion 101 and the connecting portion 103 to a virtual intersecting point where a center connecting line connecting the respective centers of the pair of semidivided cylindrical portions 101 with each other intersects each of virtually extended periphery of the semidivided cylindrical portions 101, is set substantially the same as the peripheral length of the connecting portion 103 extending from the above-mentioned connecting point to the center point of the connecting portion 103.

The above-mentioned molding step is carried out by holding the flat plate between given metal molds and then molding the same by pressing.

Figure 4A:
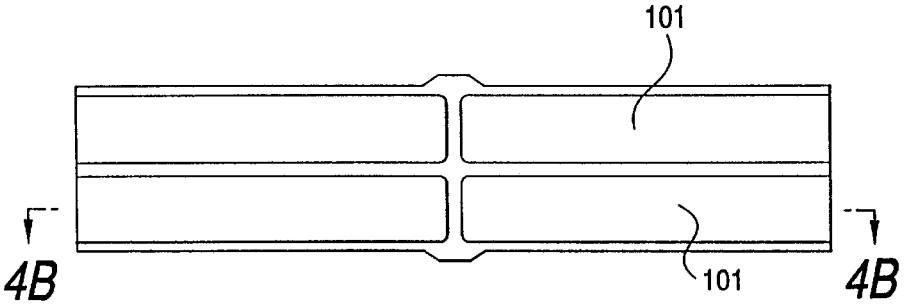
FIGS. 4A–4C are explanatory views of a second molding step employed in the above embodiment of a method for manufacturing a header pipe according to the invention.
Figure 4C:
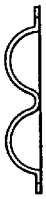
Figure 4B:
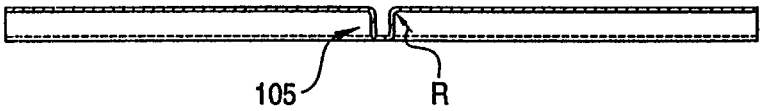

Next, according to a second molding step shown in FIGS. 4A–4C, the base portion of the partition forming portion 105 is molded into an arc shape having a given radius.

Figure 5A:
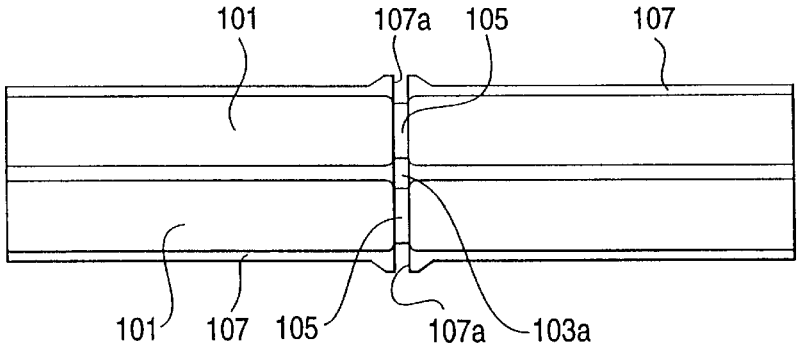
FIGS. 5A and 5B are explanatory views of a cutting step employed in the above embodiment of a method for manufacturing a header pipe according to the invention.
Figure 5B:
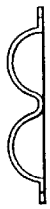

After then, according to a cutting step shown in FIGS. 5A and 5B, not only a connecting portion 103*a* situated between the two mutually adjoining partition forming portions 105 but also edge portions 107*a* respectively situated on the two sides of the partition forming portions 105 are cut and removed together with the excessively increased thickness portions of the edge portions 107.

This cutting step is executed by trimming and piercing the flat plate using a piece of press work machinery.

Figure 6A:
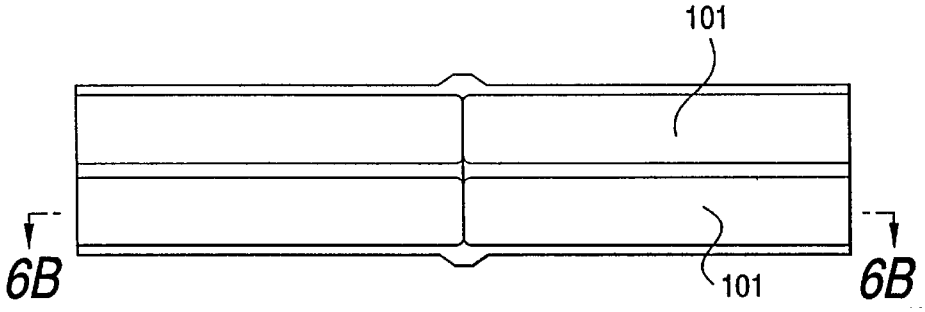
FIGS. 6A–6C are explanatory views of a cutting step employed in the above embodiment of a method for manufacturing a header pipe according to the invention.
Figure 6C:
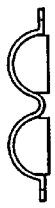
Figure 6B:
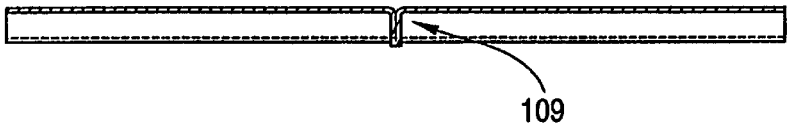

Then, according to a compressing step shown in FIGS. 6A–6C, the partition forming portions 105 are compressed from the two sides thereof to thereby form a semidivided partition portion 109.

Figure 7A:
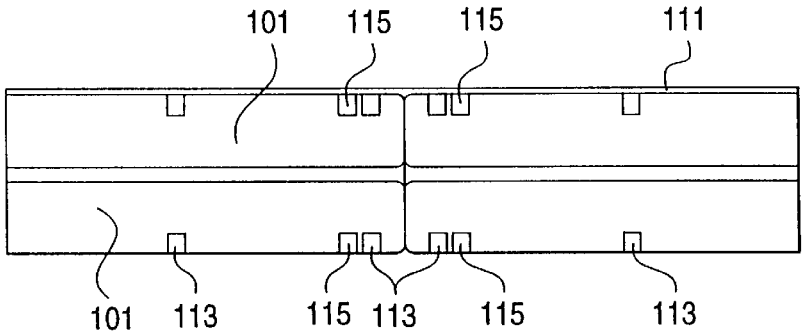
FIGS. 7A and 7B are explanatory views of an edge portion molding step and a butting step respectively employed in the above embodiment of a method for manufacturing a header pipe according to the invention.
Figure 7B:
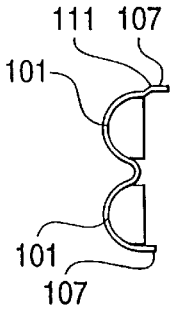

Next, according to an edge portion molding step shown in FIGS. 7A and 7B, the edge portions 107 of the pair of semidivided cylindrical portions 101 situated on the two sides thereof are molded in such a manner that, as shown in the side view of FIG. 7, each edge portion 107 is formed into an arc shape which continues with its associated semidivided cylindrical portion 10.

Also, in the edge portion 107 in which a caulking pawl portion (to be discussed later) is to be formed, there is formed a stepped portion 111 and, at the same time, securing recessed portions 113 in which the caulking pawl portions are caulked and fixed, as well as pressing recessed portions 115 are respectively worked by embossing.

This edge portion molding step is carried out by holding the pair of semidivided cylindrical portions 101 between given metal molds and then molding the same by pressing.

Figure 8A:
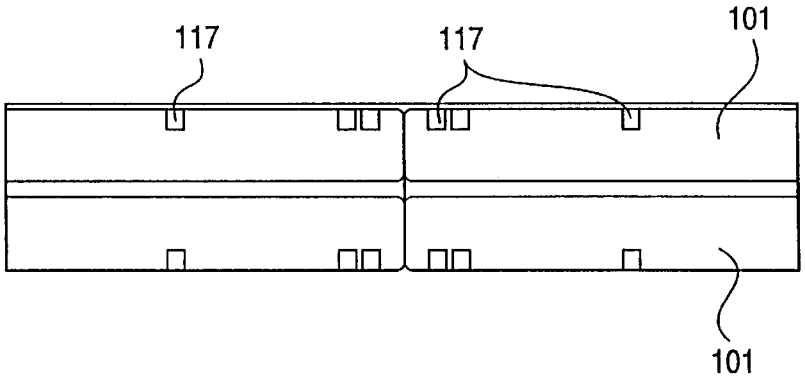
FIGS. 8A and 8B are explanatory views of a second cutting step employed in the above embodiment of a method for manufacturing a header pipe according to the invention.
Figure 8B:
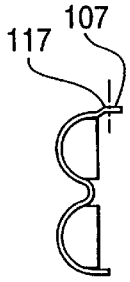

After then, according to a second cutting step shown in FIGS. 8A and 8B, the unnecessary portions of the edge portions 107 except for the portions that are used as caulking pawl portions 117 are trimmed and worked, thereby forming the caulking pawl portions 117.

Figure 9A:
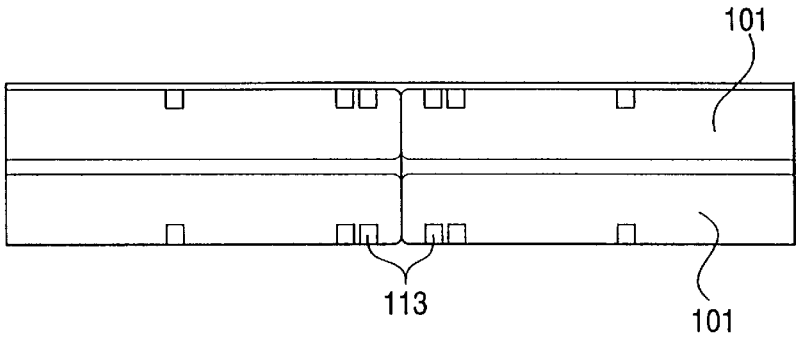
FIGS. 9A and 9B are explanatory views of a third cutting step employed in the above embodiment of a method for manufacturing a header pipe according to the invention.
Figure 9B:
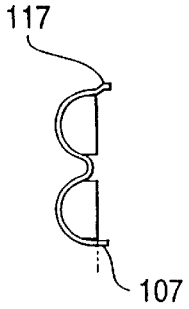

Next, according to a third cutting step shown in FIGS. 9A and 9B, the unnecessary portions of the edge portions 107 on the securing recessed portions 113 side are removed by trim working.

Figure 10A:
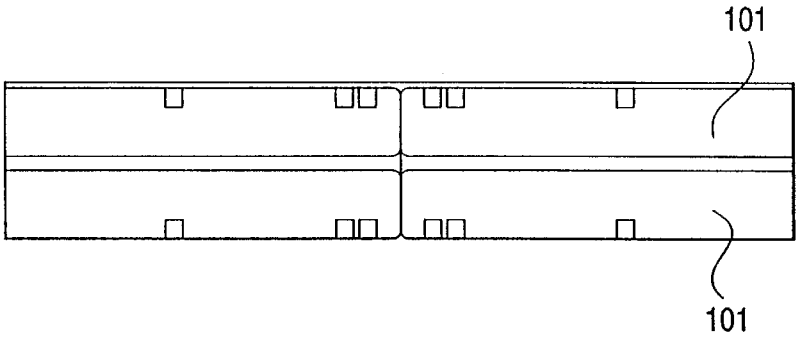
FIGS. 10A and 10B are explanatory views of a restriking step employed in the above embodiment of a method for manufacturing a header pipe according to the invention.
Figure 10B:
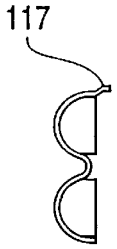

After then, according to a restriking step shown in FIGS. 10A and 10B, the staking pawl portions 117 are restruck into right angles.

Figure 11A:
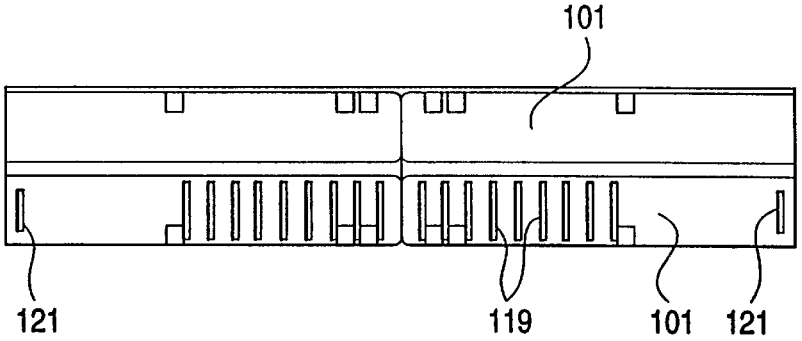
FIGS. 11A and 11B are explanatory views of a first tube insertion hole forming step employed in the above embodiment of a method for manufacturing a header pipe according to the invention.
Figure 11B:
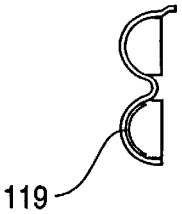

Next, according to a first tube insertion hole forming step shown in FIGS. 11A and 11B, in the central portion of one of the pair of semidivided cylindrical portions 101, there are formed a plurality of tube insertion holes 119 which are spaced at given intervals from each other and, on the two sides of the present semidivided cylindrical portion 101, there are formed side plate insertion holes 121.

By the way, the length of the tube insertion hole 119, as shown in FIG. 1, is set as the length that is required of a header pipe having a given outside diameter dimension to be manufactured.

This tube insertion hole forming step can be achieved by slit/pierce molding the flat plate using a piece of press work machinery.

Figure 12A:
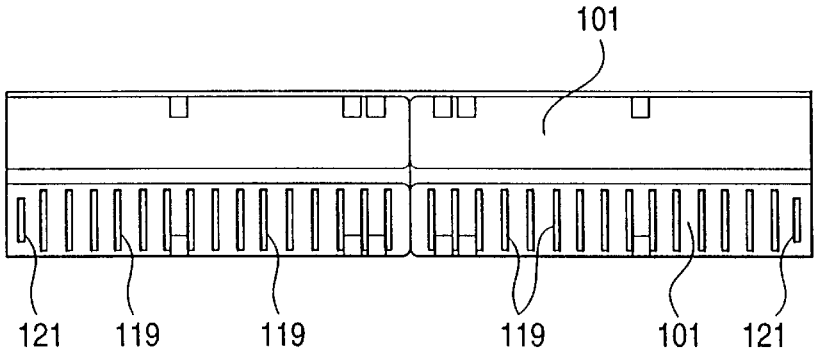
FIGS. 12A and 12B are explanatory views of a second tube insertion hole forming step employed in the above embodiment of a method for manufacturing a header pipe according to the invention.
Figure 12B:
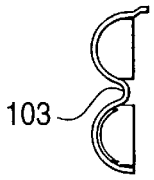

Next, according to a second tube insertion hole forming step shown in FIGS. 12A and 12B, on the two sides of the tube insertion holes 119 formed in the central portion of the semidivided cylindrical portion 101, there are formed another tube insertion holes 119 in such a manner that they are spaced at given intervals from each other.

This second tube insertion hole forming step can be achieved by slit/pierce molding the flat plate using a piece of press work machinery.

Figure 13A:
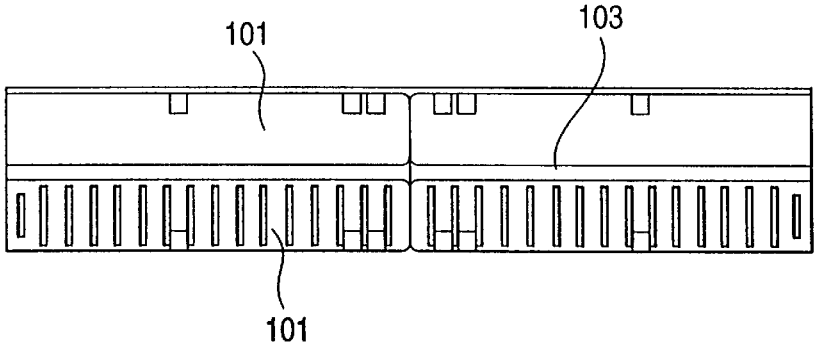
FIGS. 13A and 13B are explanatory views of a mutually opposing step employed in the above embodiment of a method for manufacturing a header pipe according to the invention.
Figure 13B:
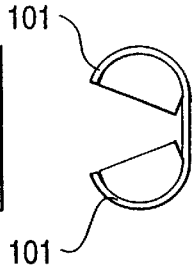

Then, according to a mutually opposing step shown in FIGS. 13A and 13B, the connecting portion 103 is projected from the inside thereof to thereby dispose the pair of semidivided cylindrical portions 101 in such a manner that they are opposed to each other.

Figure 14A:
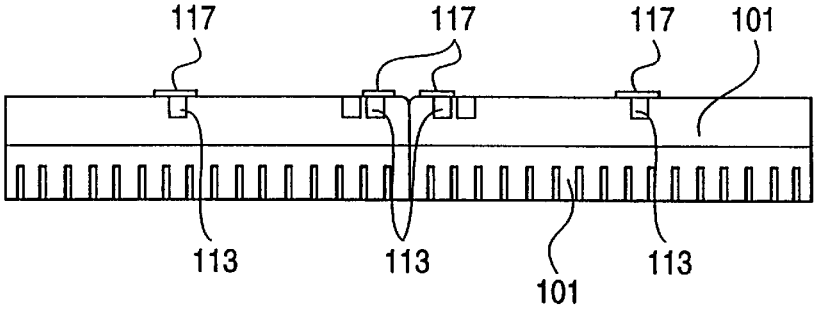
FIGS. 14A and 14B are explanatory views of a butting step employed in the above embodiment of a method for manufacturing a header pipe according to the invention.
Figure 14B:
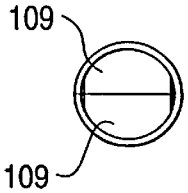
Figure 15:
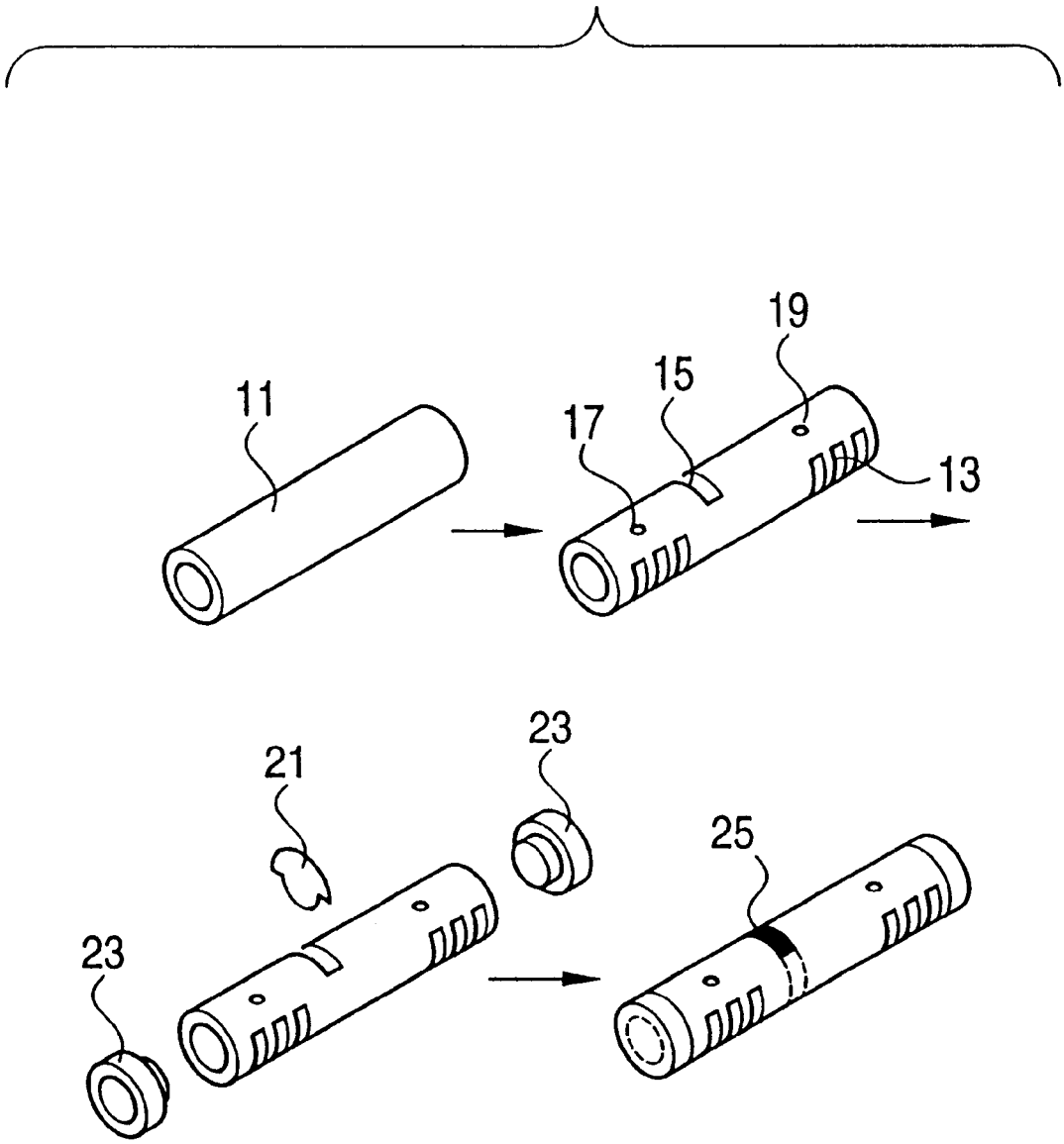
FIG. 15 PRIOR ART
FIG. 15 is an explanatory view of a first conventional method for manufacturing a header pipe.
Figure 16:
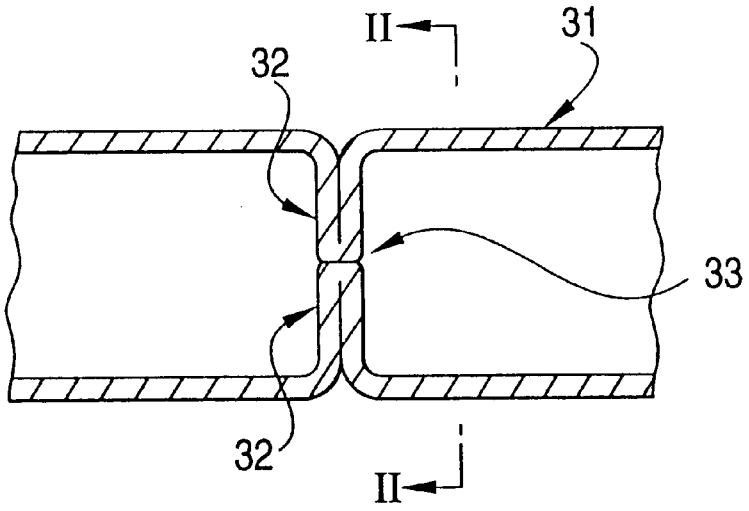
FIG. 16 PRIOR ART
FIG. 16 is a section view of a pipe with a partition manufactured according to a second conventional method for manufacturing a header pipe.
Figure 17:
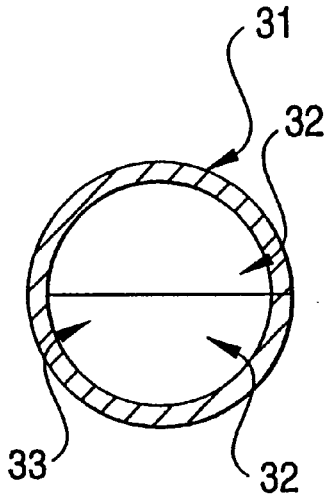
FIG. 17 PRIOR ART
FIG. 17 is a section view taken along the line II—II shown in FIG. 16.
Figure 18C:
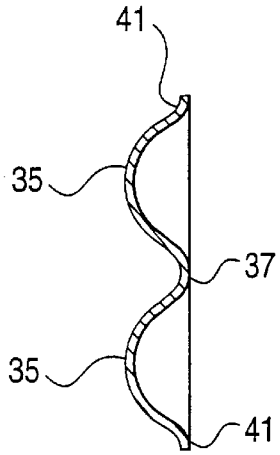
FIG. 18C PRIOR ART
FIGS. 18A–18C are explanatory views of a molding step employed in the second conventional method for manufacturing a header pipe.
Figure 18A:
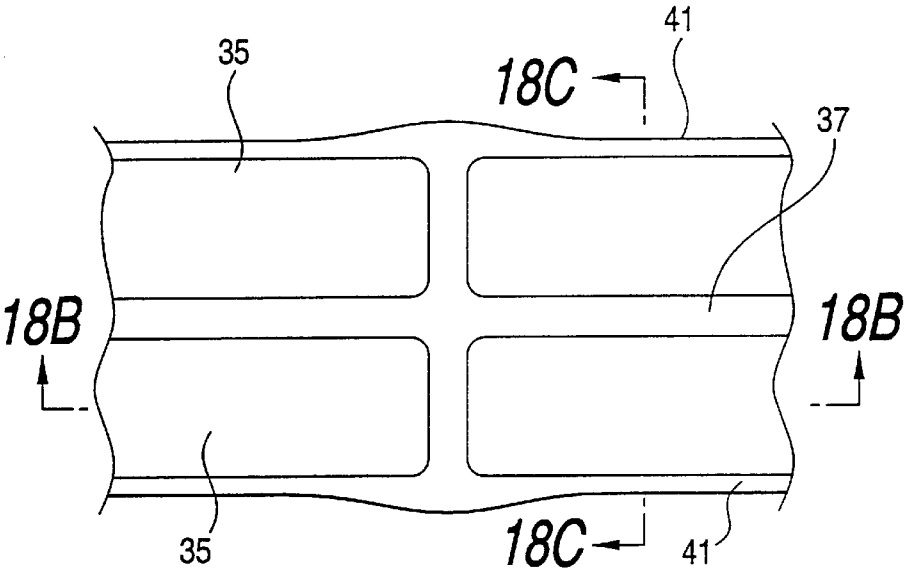
FIG. 18A PRIOR ART
Figure 18B:
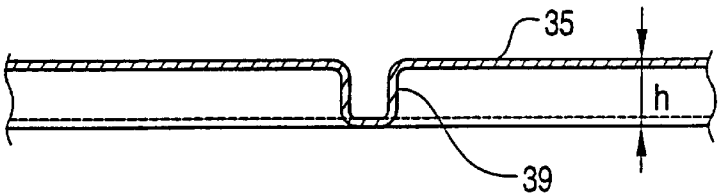
FIG. 18B PRIOR ART
Figure 19A:
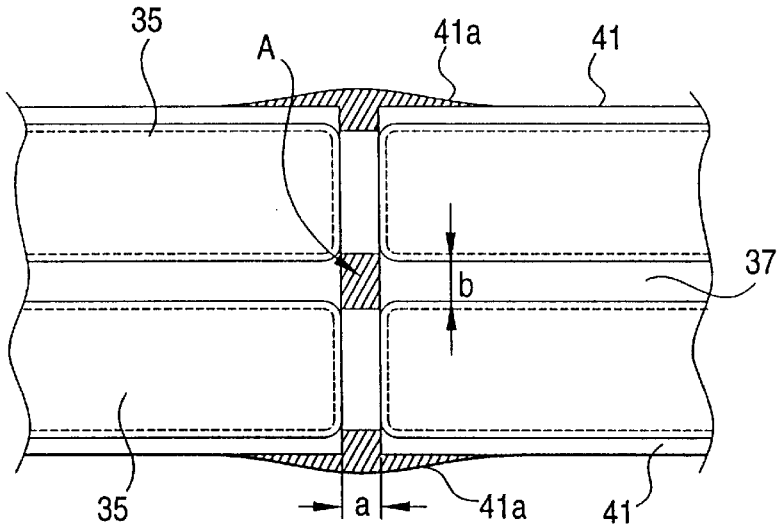
FIG. 19A PRIOR ART
FIGS. 19A and 19B are explanatory views of a cutting step employed in the second conventional method for manufacturing a header pipe.
Figure 19B:
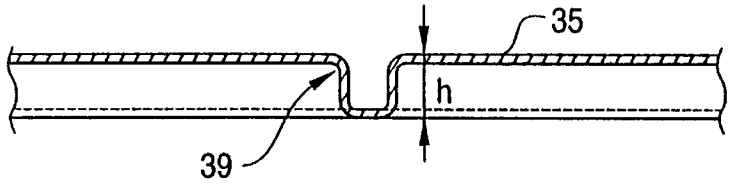
FIG. 19B PRIOR ART
Figure 20A:
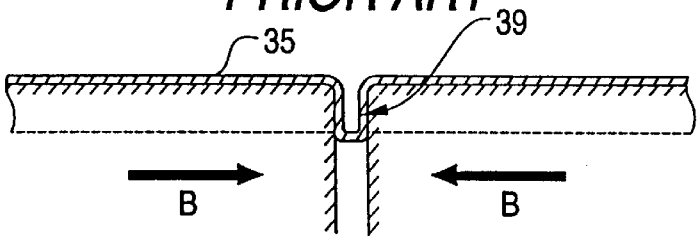
FIG. 20A PRIOR ART
FIGS. 20A and 20B are explanatory views of a compressing step employed in the second conventional method for manufacturing a header pipe.
Figure 20B:
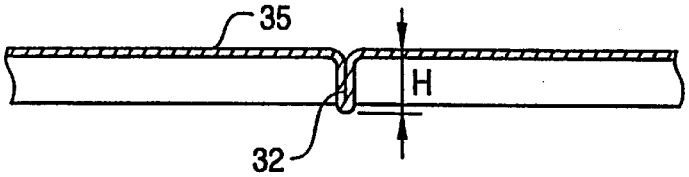
FIG. 20B PRIOR ART
Figure 21A:
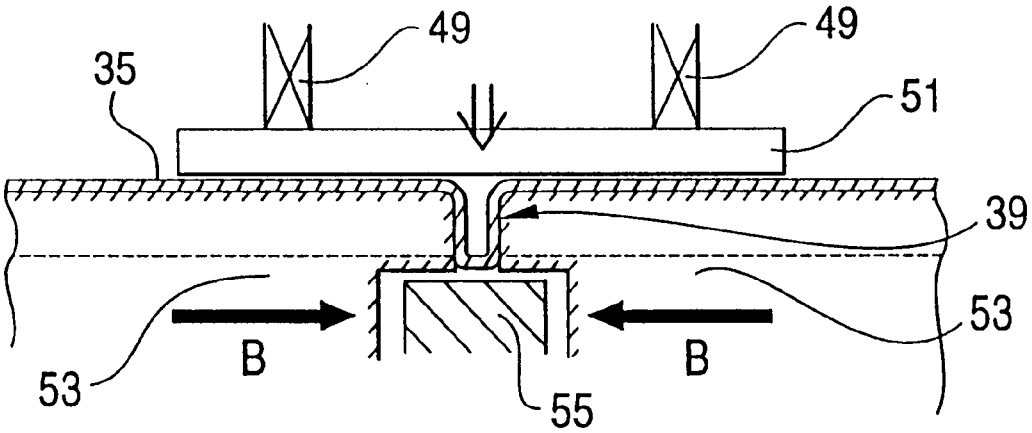
FIG. 21A PRIOR ART
FIGS. 21A and 21B are explanatory views of the compressing step shown in FIG. 20 which is under execution.
Figure 21B:
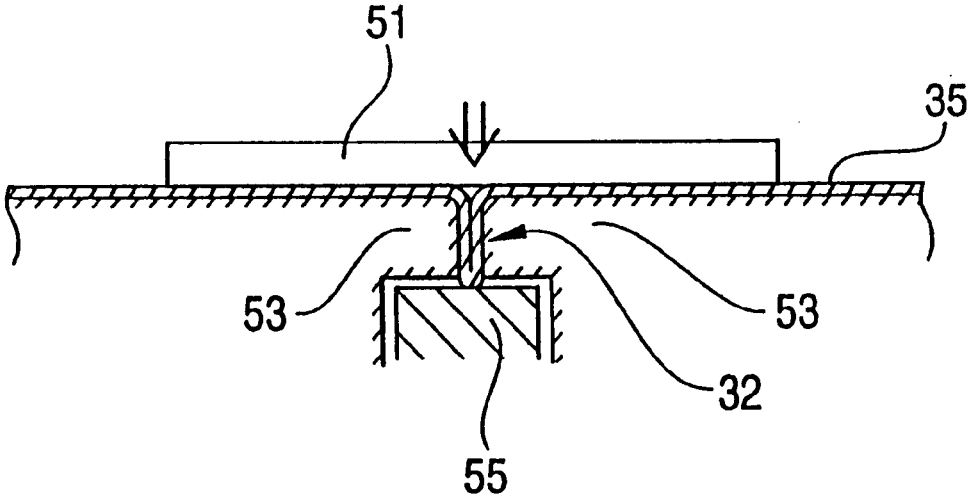
FIG.21B PRIOR ART
Figure 22A:
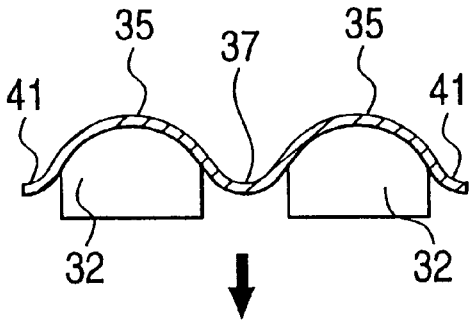
FIG. 22A PRIOR ART
FIGS. 22A and 22B are explanatory views of an edge portion molding step employed in the second conventional method for manufacturing a header pipe.
Figure 22B:
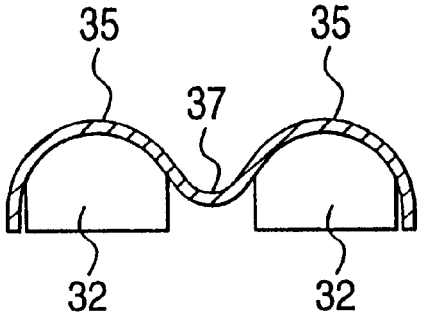
FIG.22B PRIOR ART
Figure 23A:
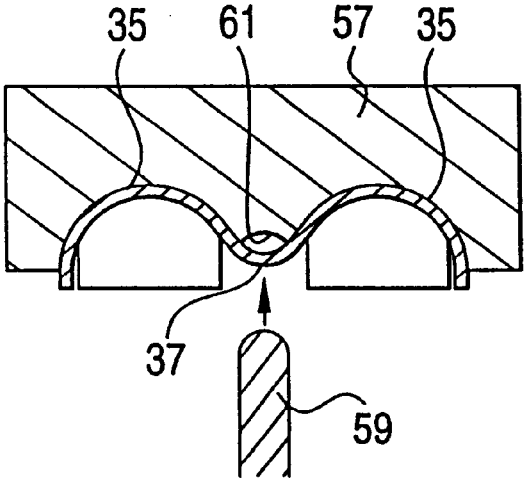
FIG. 23A PRIOR ART
FIGS. 23A and 23B are explanatory views of a mutually opposing step employed in the second conventional method for manufacturing a header pipe.
Figure 23B:
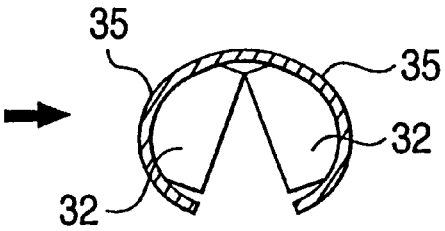
FIG.23B PRIOR ART
Figure 24A:
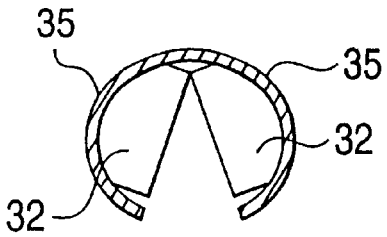
FIG. 24A PRIOR ART
FIGS. 24A and 24B are explanatory views of a butting step employed in the second conventional method for manufacturing a header pipe.
Figure 24B:
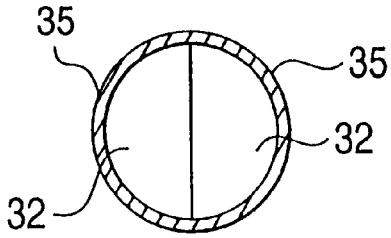
FIG. 24B PRIOR ART
Figure 25A:
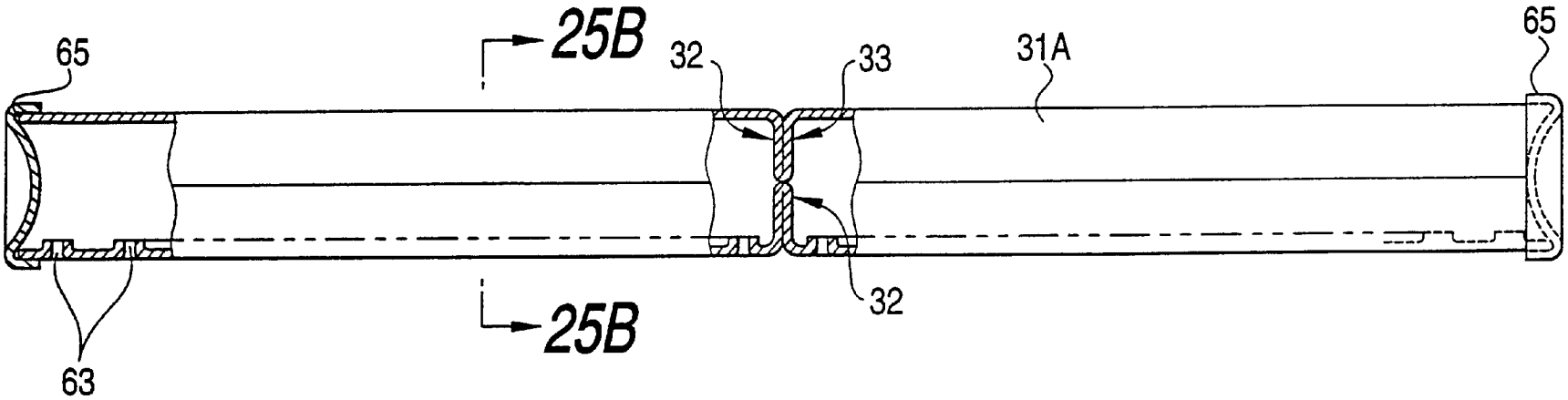
FIG. 25A PRIOR ART
FIGS. 25A and 25B are side and sectional views, respectively, of a header pipe with a partition in which there are formed tube insertion holes according to the second conventional method for manufacturing a header pipe.
Figure 25B:
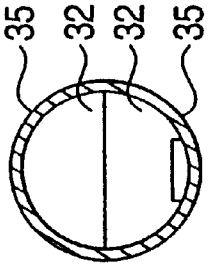
FIG. 25B PRIOR ART
Figure 26:
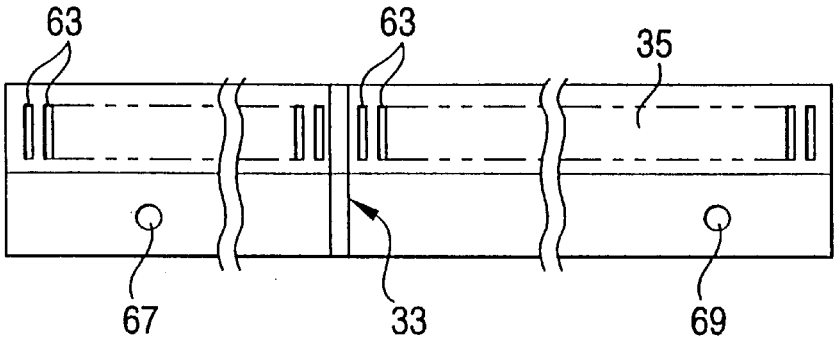
FIG. 26 PRIOR ART
FIG. 26 is an explanatory view of a tube insertion hole forming step employed in the second conventional method for manufacturing a header pipe.
Figure 27:
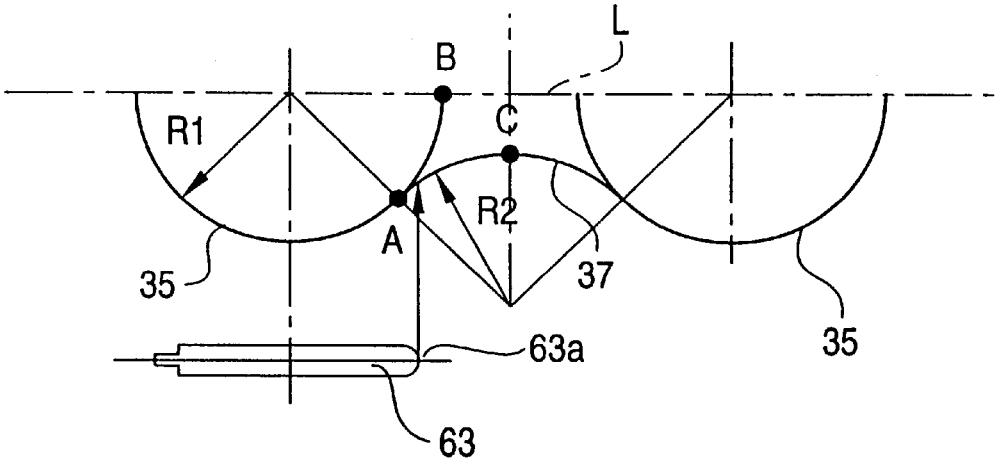
FIG. 27 is an explanatory view of a molding shape molded in the second conventional molding step.
Figure 28:
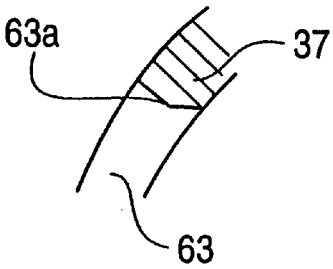
FIG. 28 is an explanatory view of the deformation of the conventional tube insertion hole.

Next, according to a butting step shown in FIGS. 14A and 14B, the mutually opposed semidivided cylindrical portions 101 are butted against each other.

Then, the caulking pawl portions 117 are respectively staked and fixed to the securing recessed portions 113 according to a caulking step (not shown) and, in such staked and fixed state, not only the pair of semidivided cylindrical portions 101 but also the pair of semidivided partition portions 109 are connected to each other.

By the way, according to the present embodiment, the connecting step is executed by performing a brazing operation using non-corrosive flux.

In the thus manufactured header pipe with a partition, while preventing the end portions of the tube insertion holes 119 from being deformed, the length of the tube insertion hole 119 can be set as the length that is required of a header pipe having a given outside diameter dimension.

As has been described heretofore, according to a method for manufacturing a header pipe in the present invention, the tube insertion hole are formed only in one of the pair of semidivided cylindrical portions in such a manner that the tube insertion holes are not allowed to extend up to the connecting portion. Due to this, after then, when the mutually opposing step and butting step are carried out to thereby manufacture the cylindrically-shaped header pipe, it is possible to surely prevent the end portions of the tube insertion holes from being deformed.

Also, since the radius of the connecting portion is set smaller than the radius of the semidivided cylindrical portion, it is possible to increase the outer peripheral length of the semidivided cylindrical portion, so that the length of the tube insertion hole can be set easily as the length that is required of a header pipe having a given outside diameter dimension.

Further, the virtual peripheral length of the semidivided cylindrical portion, which extends from the connecting point between the semidivided cylindrical portion and the connecting portion to a virtual intersecting point where the center connecting line connecting the respective centers of the pair of semidivided cylindrical portions with each other intersects each of virtually extended periphery of the semidivided cylindrical portions, is set substantially the same as the peripheral length of the connecting portion extending from the above-mentioned connecting point to the center point of the connecting portion.

Then, by carrying out the mutually opposing step and butting step, the cylindrically-shaped header pipe can be surely produced.

What is claimed is:

1. A method for manufacturing a header pipe, comprising the steps of:

molding a flat plate so that a pair of semidivided cylindrical portions are arranged in parallel to each other with a connecting portion therebetween;

forming a tube insertion hole in one of the pair of semidivided cylindrical portions so that said tube insertion hole is not allowed to extend up to said connecting portion;

projecting said connecting portion to thereby dispose said pair of semidivided cylindrical portions so as to be opposed to each other;

butting said mutually opposed semidivided cylindrical portions against each other; and connecting said semidivided cylindrical portions by at least one of brazing and caulking, thereby manufacturing a cylindrically-shaped header pipe.

2. The method for manufacturing a header pipe according to claim 1, wherein said connecting portion is arc-shaped in a cross section, and a radius of said connecting portion in the cross section is set smaller than a radius of said semidivided cylindrical portions in a cross section.

3. The method for manufacturing a header pipe according to claim 2, wherein a virtual peripheral length of each of said semidivided cylindrical portions in a cross section, which extends from a connecting point of each of said semidivided cylindrical portions and said connecting portion to a virtual intersecting point where a center connecting line connecting respective centers of said pair of semidivided cylindrical portions with each other intersect each of virtually extended peripheries of said semidivided cylindrical portions, is substantially the same as a peripheral length of said connecting portion in a cross section extending from said connecting point to a center point of said connecting portion.

4. The method for manufacturing a header pipe according to claim 1, wherein said connecting portion is arc-shaped in a cross section, and a virtual peripheral length of each of said semidivided cylindrical portions in a cross section, which extends from a connecting point of each of said semidivided cylindrical portions and said connecting portion to a virtual intersecting point where a center connecting line connecting respective centers of said pair of semidivided cylindrical portions with each other intersect each of virtually extended peripheries of said semidivided cylindrical portions, is substantially the same as a peripheral length of said connecting portion in a cross section extending from said connecting point to a center point of said connecting portion.

5. The method for manufacturing a header pipe according to claim 2, wherein a length of an arc tended by a radius of curvature of one of said semidivided cylindrical portions between a first point and a second point is substantially equal to a transverse length of said connecting portion between a center point of said connecting portion and said second point, wherein said first point is a point of intersection between said arc and a line drawn from a center of said radius of curvature of said one of said semidivided cylindrical portions to a center of a radius of curvature of another of said semidivided cylindrical portions, and wherein said second point is a point of intersection between said arc and a line drawn from said center of said radius of curvature of said one of said semidivided cylindrical portions to a center of a radius of curvature of said connecting portion.

6. The method for manufacturing a header pipe according to claim 1, wherein said connecting portion is arc-shaped in cross section, said arc-shape being defined by a radius of curvature of said connecting portion, wherein a length of an arc tended by a radius of curvature of one of said semidivided cylindrical portions between a first point and a second point is substantially equal to a transverse length of said connecting portion between a center point of said connecting portion and said second point, wherein said first point is a point of intersection between said arc and a line drawn from a center of said radius of curvature of said one of said semidivided cylindrical portions to a center of a radius of curvature of another of said semidivided cylindrical portions, and wherein said second point is a point of intersection between said arc and a line drawn from said center of said radius of curvature of said one of said semidivided cylindrical portions to a center of a radius of curvature of said connecting portion.

7. The method for manufacturing a header pipe according to claim 1, wherein said connecting portion is defined in cross section by a transverse length between a first point and a second point, wherein said first point lies along a line drawn from a center of a radius of curvature of one of said semidivided cylindrical portions to a center of a radius of curvature of said connecting portion, wherein said second point lies along a line drawn from a center of a radius of curvature of another of said semidivided cylindrical portions to said center of a radius of curvature of said connecting portion.

8. The method for manufacturing a header pipe according to claim 1, wherein said connecting portion is defined in cross section by a transverse length between a first point of inflection of one of said semidivided cylindrical portions and a second point of inflection of another of said semidivided cylindrical portions.

* * * * *